US005497517A

United States Patent [19]

Wang

[11] Patent Number: 5,497,517

[45] Date of Patent: Mar. 12, 1996

[54] CONTROL DEVICE FOR FOLDING AND EXPANDING A BASE PORTION OF A PLAYPEN

[76] Inventor: Kun Wang, No. 51, Lane 31, Sec. 2, Changping Rd., Taichung, Taiwan

[21] Appl. No.: 296,321

[22] Filed: Aug. 25, 1994

[51] Int. Cl.[6] ..... A47D 7/00

[52] U.S. Cl. ..... 5/99.1; 403/102; 403/291

[58] Field of Search ..... 5/99.1, 98.1; 16/326, 16/325; 403/291, 102

[56] References Cited

U.S. PATENT DOCUMENTS 5,279,006 1/1994 Teng ..... 5/99.1

5,353,451 10/1994 Hsiung ..... 5/99.1

*Primary Examiner*—Alexander Grosz

*Attorney, Agent, or Firm*—Ross, Clapp, Korn & Montgomery

[57] ABSTRACT

A control device for folding and expanding a base portion of a playpen includes four block members each fixed on a base portion which is mounted on a mediate portion of the playpen and each pivotally engaged with one of four drive posts each of which is mounted on one of the four corners of the playpen, four fastener members each mounted on a mediate portion of one of the drive posts, two transmission assemblies each including a bracket member mounted in a mediate portion thereof, a pair of linking rods each having a first end pivotally engaged with one of the fastener members on associated drive post and having a second end pivotally engaged with the bracket member.

4 Claims, 7 Drawing Sheets

CONTROL DEVICE FOR FOLDING AND EXPANDING A BASE PORTION OF A PLAYPEN

BACKGROUND OF THE INVENTION

1. Field of Invention

The present invention relates to a control device, and more particularly to a control device for folding and expanding a base portion of a playpen.

2. Related Prior Art

A conventional control device for folding and expanding a base portion of a playpen is complex in structure and it is not easy to perform the operation of folding and expanding the playpen.

The present invention has arisen to mitigate and/or obviate the above-mentioned disadvantages of the conventional playpen.

SUMMARY OF THE INVENTION

In accordance with one aspect of the present invention, there is provided a control device for folding and expanding a base portion of a playpen which comprises four vertical stands respectively mounted on four corners thereof and a base portion mounted on an underside thereof, four drive posts each having a first end connecting to a lower end of one of the four vertical stands and having a second end connecting to the base portion, and a flexible casing enclosed around a peripheral portion of the playpen and having an underside engaged with the base portion, the control device comprising four block members each fixed on the base portion and pivotally engaged with the second end of one of the drive posts, four fastener members each mounted on a mediate portion of one of the drive posts, two transmission assemblies each mounted between two of the four drive posts and opposite to each other, each of the transmission assemblies comprising a bracket member mounted in a mediate portion thereof, a pair of linking rods each having a first end pivotally engaged with one of the fastener members on associated drive post and having a second end pivotally engaged with the bracket member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
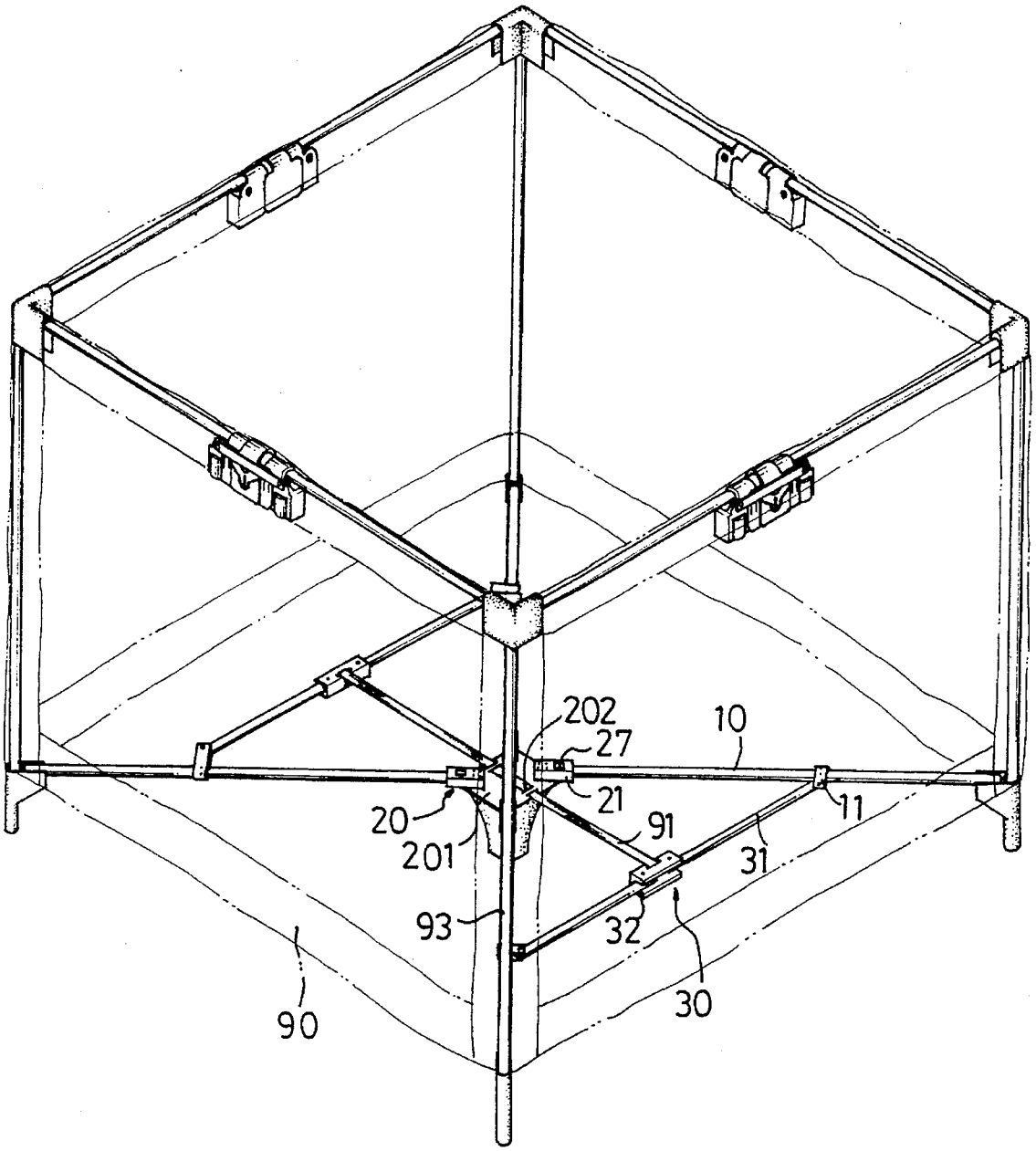
FIG. 1 is a perspective view of a playpen in accordance with the present invention.
Figure 2:
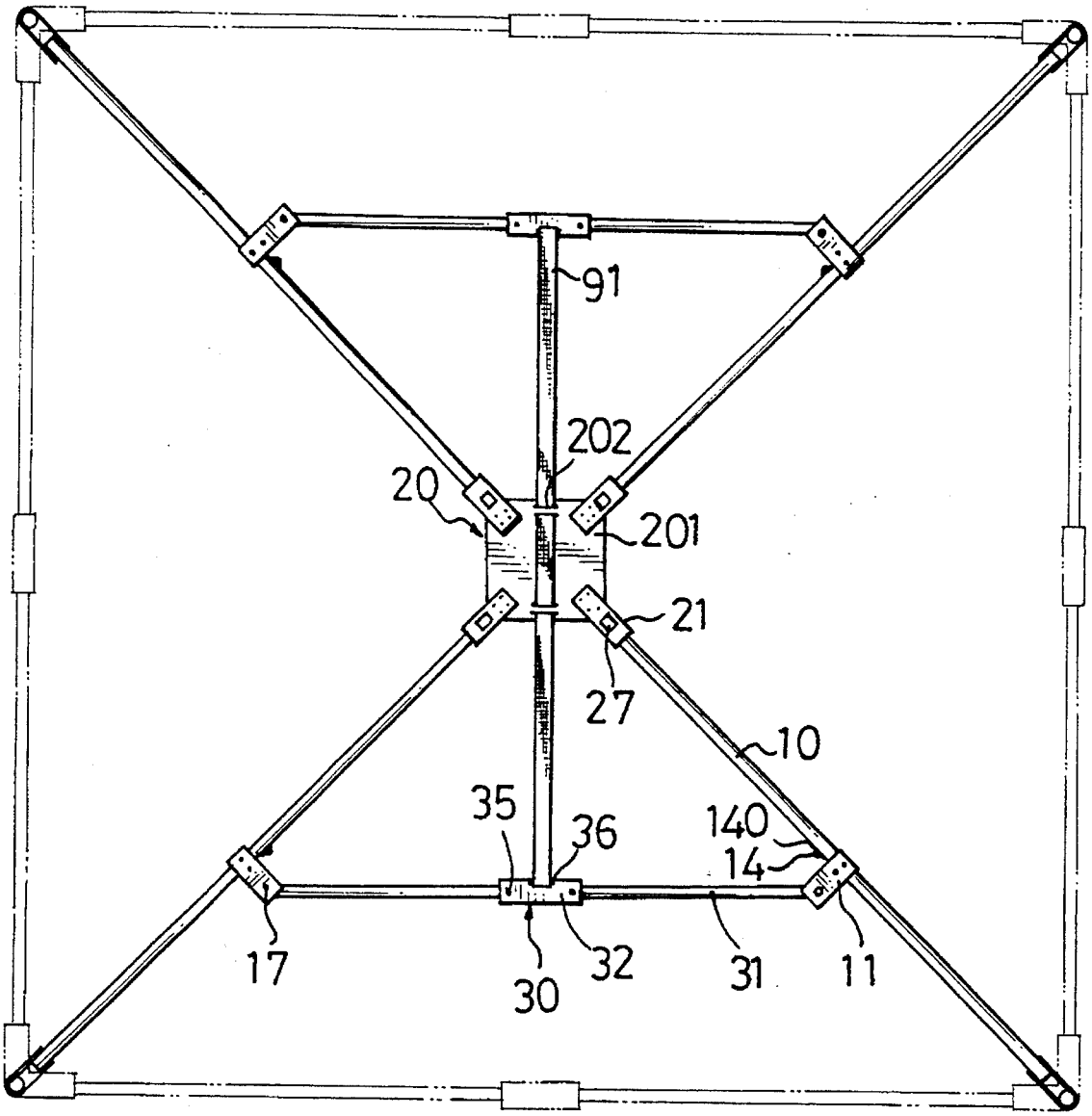
FIG. 2 is top plan view as shown in FIG. 1 showing the playpen in an expanded status.

Referring to the drawings, and initially to FIGS. 1 and 2, a control device in accordance with the present invention is provided for folding and expanding a base portion of a playpen which comprises four vertical stands 93 respectively mounted on four corners thereof and a base portion 20 mounted on a mediate portion of an underside thereof, four drive posts 10 each having a first end pivotally connected to a lower end of one of the four vertical stands 93 and having a second end pivotally engaged to a top plate 201 of the base portion 20 by a block member 21, and a flexible casing 90 (shown in phantom lines) enclosed around a peripheral portion of the playpen and having an underside connected to the top plate 201 of the base portion 20, the control device comprising of four of the block members 21 each fixed-on the top plate 201 of the base portion 20 and pivotally engaged with the second end of one of the drive posts 10, four fastener members 11 each mounted on a mediate portion of one of the drive posts 10, two transmission assemblies 30 each mounted between two of the four drive posts 10 and opposite to each other, each of the transmission assemblies 30 comprising a bracket member 32 mounted in a mediate portion thereof, a pair of linking rods 31 each having a first end pivotally engaged with one of the fastener members 11 on an associated drive post 10 and having a second end pivotally engaged with the bracket member 32.

Figure 3:
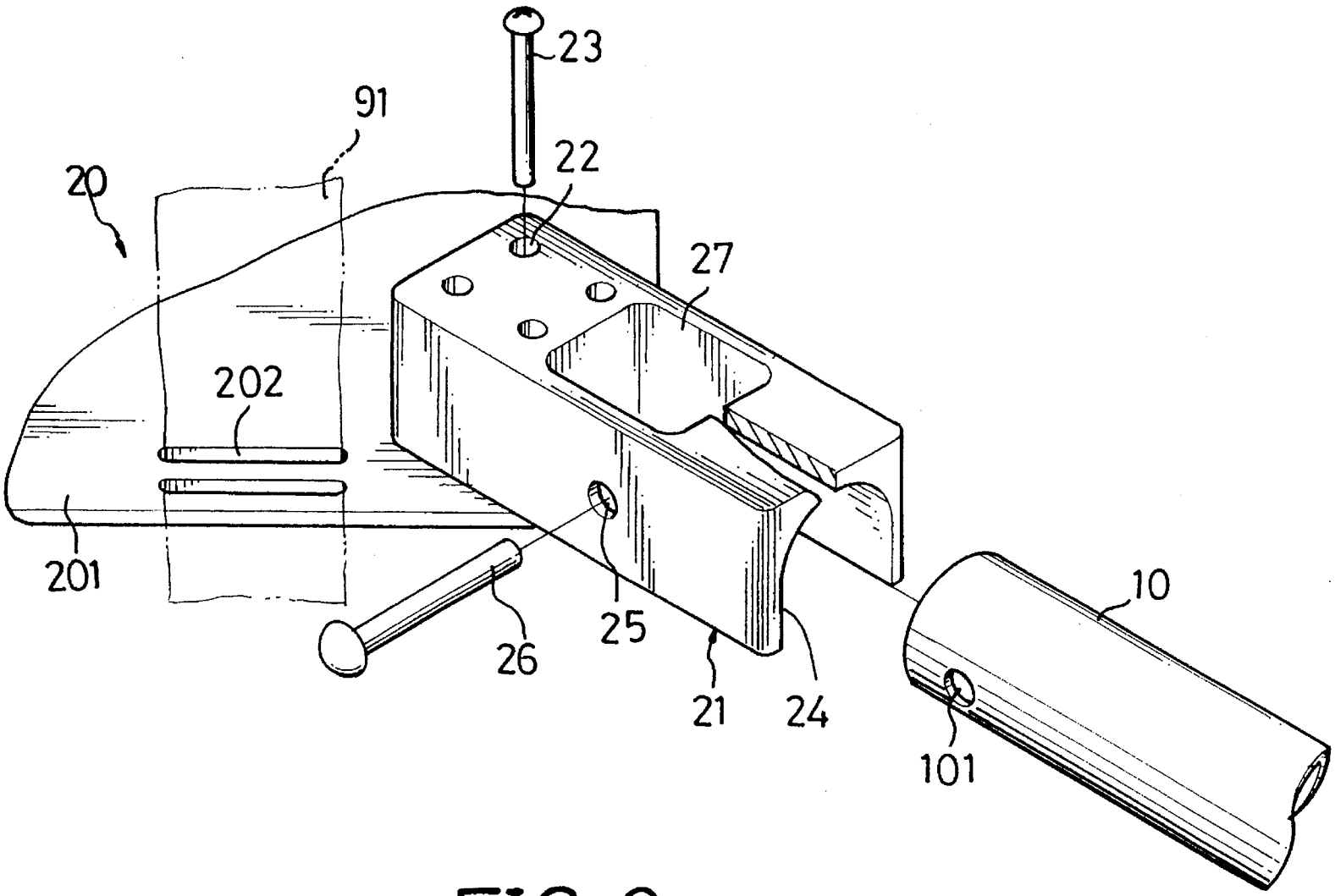
FIG. 3 is a partially cross-sectional perspective view showing how a block member engages with a drive post and a base portion.

Referring to FIG. 3, each of the four block members 21 is fixed on the top plate 201 by four rivets 23 each of which extends through a hole 22 defined in the block member 21 which also defines a longitudinal recess 24 having an opening facing downwardly and further define a vertical compartment 27 therethrough which communicates with the recess 24, a pair of aligned holes 25 transversely defined through the block member 21 and communicating with the vertical compartment 27, the second end of one of the drive posts 10 being received in the longitudinal recess 24 and defining a transverse bore 101 therethrough which aligns with the pair of holes 25, a pivot axle 26 extending through the pair of holes 25 and the bore 101 such that the drive post 10 is pivotally engaged with the block member 21 at the pivot axle 26, whereby, the second end of the drive post 10 is received in the vertical compartment 27 when the drive post 10 is rotated about the pivot axle 26.

Figure 4:
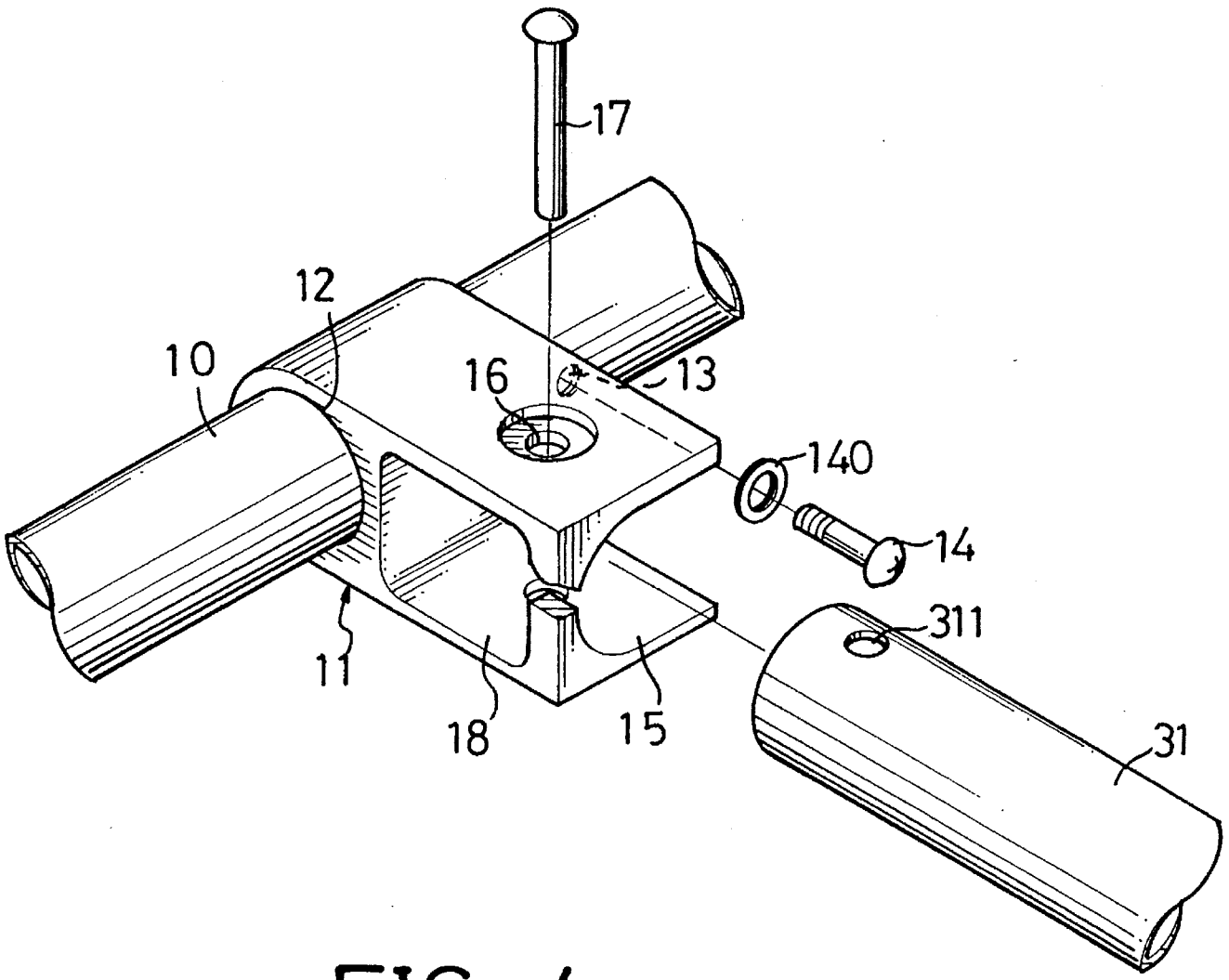
FIG. 4 is an exploded perspective view showing how a fastener member engages with a drive post and a linking rod.

Referring to FIG. 4, each of the four fastener members 11 defines a recess 15 therein having an opening facing towards the base portion 20 and defines a compartment 18 therethrough which communicates with the recess 15, a pair of aligned holes 16 vertically defined through the fastener member 11 and communicating with the compartment 18, the first end of one of the linking rods 31 being received in the recess 15 and defining a vertical bore 311 therethrough which communicates with the pair of holes 16, a pivot axle 17 extending through the pair of holes 16 and the vertical bore 311 such that the linking rod 31 is pivotally engaged with the fastener member 11 at the pivot axle 17, whereby, the first end of the linking rod 31 is received in the compartment 18 when the linking rod 31 is rotated about the pivot axle 17. A screw hole 13 is defined in each of the drive posts 10 near a corresponding fastener member 11, a bolt 14 extending through a washer 140 is threadedly engaged in the screw hole 13 for biasing against the fastener member 11 so as to inhibit a displacement of the fastener member 11 relative to the drive post 10 towards the base portion 20.

Figure 5:
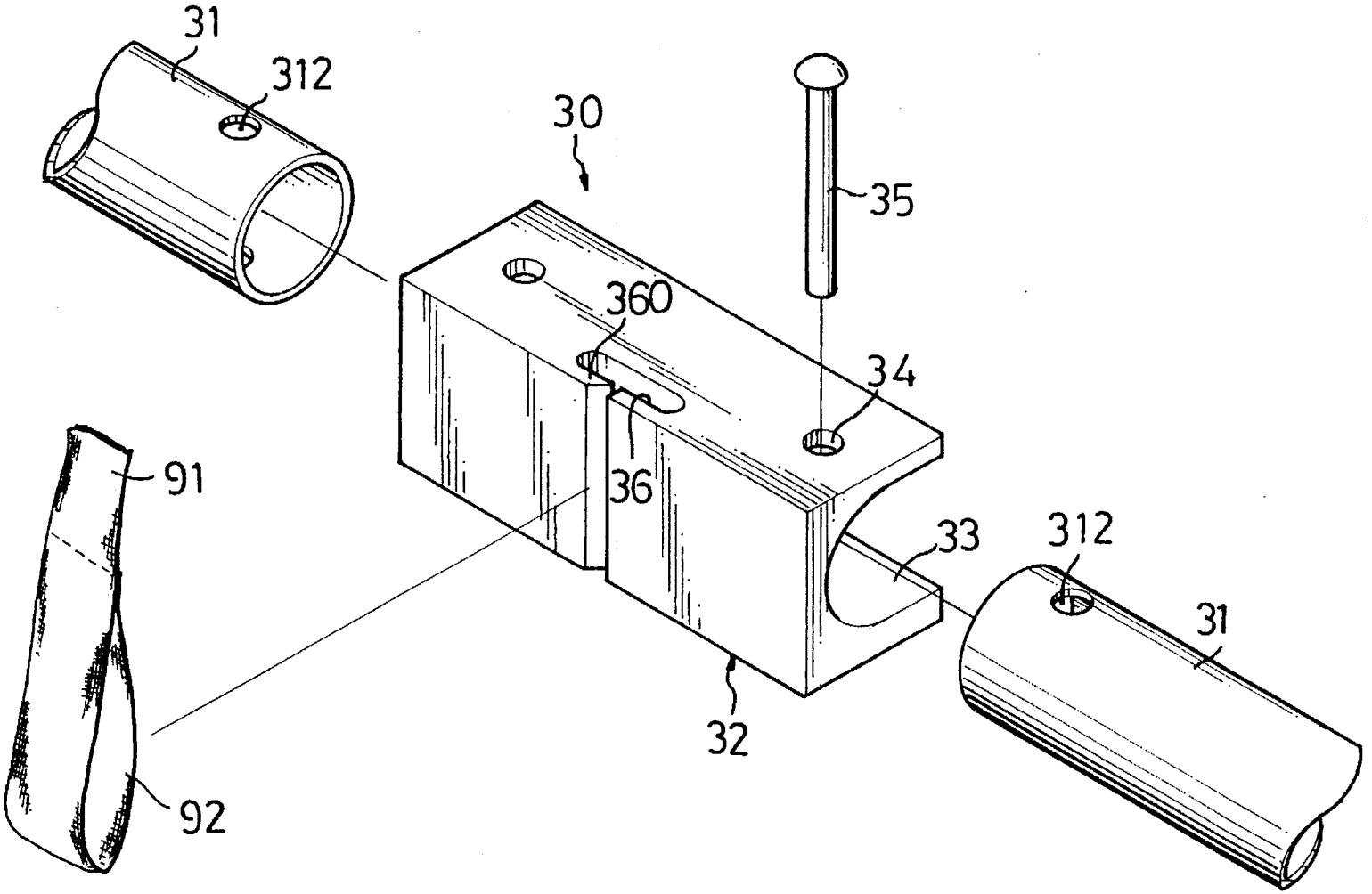
FIG. 5 is a perspective view showing how a bracket member engages with a pair of linking rods.

Referring to FIG. 5, each of the two bracket members 32 has two distal ends and defines a substantially U-shaped recess 33 therethrough which has an opening facing opposite the base portion 20, a pair of aligned holes 34 vertically defined through each of the two distal ends of the bracket member 32, the second end of each of the linking rods 31 being received in the recess 33 and defining a vertical bore 312 therethrough which communicates with the pair of holes 34 in a corresponding distal end of the bracket member 32, a pair of pivot axles 35 each extending through the pair of holes 34 and the vertical bore 312 such that each of the linking rods 31 is pivotally engaged with the bracket member 32 at the pivot axle 35. Each of the two bracket members 32 defines a substantially T-shaped slot 36 having an opening facing the base portion 20 and forms two flange portions 360 thereon, a resilient strip 91 has a mediate portion attached to the base portion 20, as shown in FIG. 1, and has two free ends each of which is formed into a loop 92 so as to be fitted on the two flange portions 360 of the bracket member 32 through the opening of the T-shaped slot 36. Preferably, with reference to FIGS. 2 and 3, two pairs of elongated slots 202 are each defined through one side of the top plate 201 of the base portion 20, the resilient strip 91 initially extends through a pair of slots 202 on one side of the top plate 201, then passes through two bores defined in an underside of the flexible casing 90 and finally extends through the pair of slots 202 on the other side of the top plate 201 such that the underside of the flexible casing 90 together with the resilient strip 91 is attached to the top plate 201 of the base portion 20.

Figure 6:
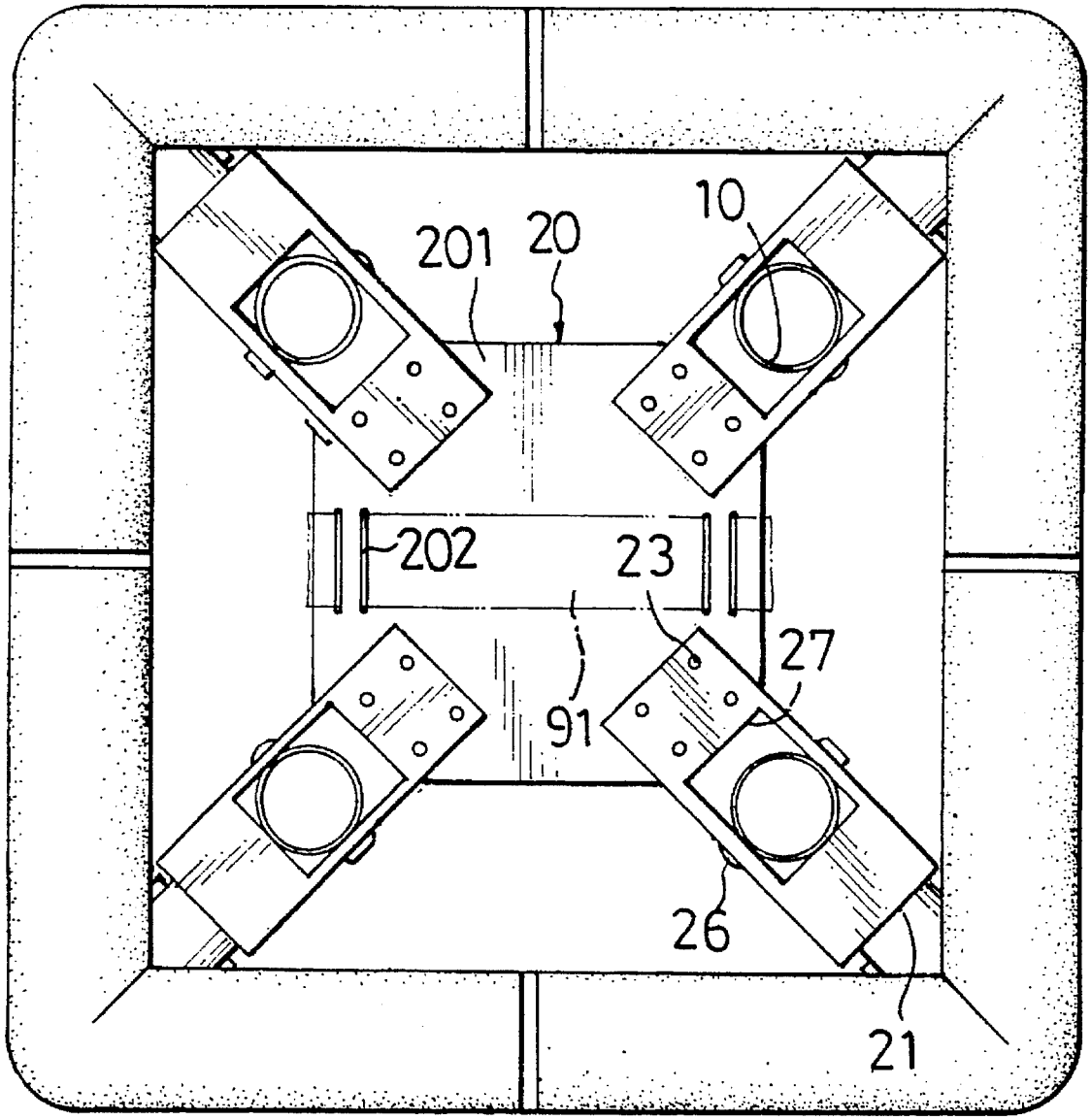
FIG. 6 is an enlarged top plan view showing the playpen in a folded status.
Figure 7:
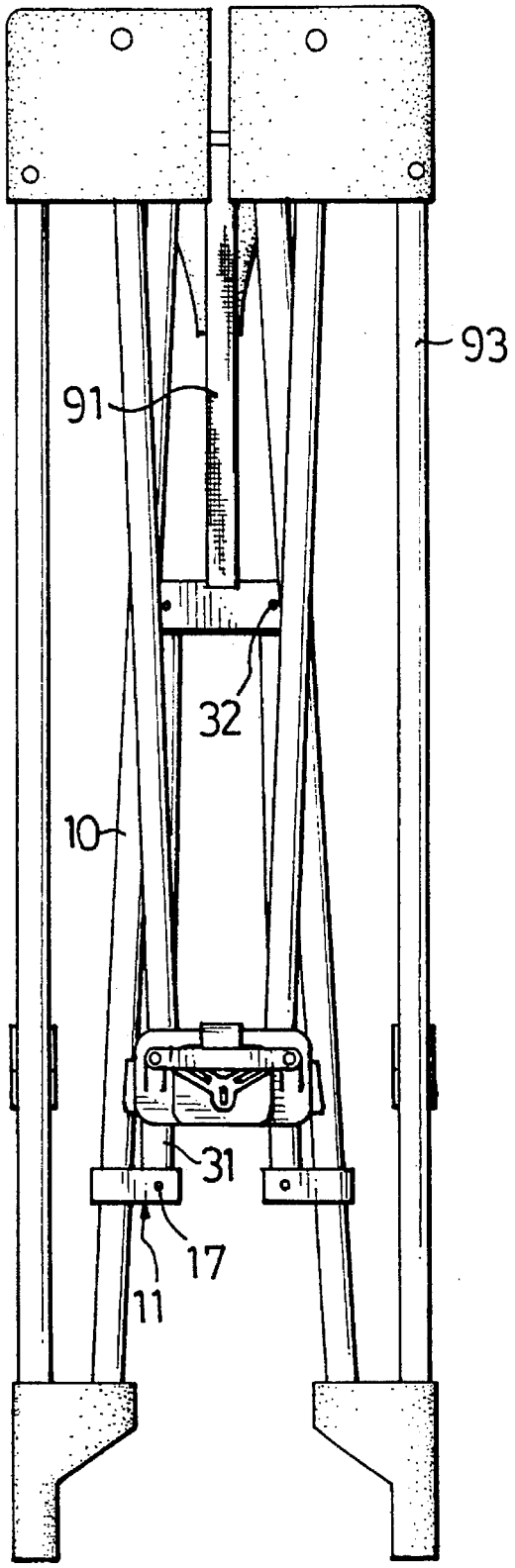
FIG. 7 is front plan view showing the playpen in a folded status.

In operation, referring to FIGS. 1, 2 and 6, in order to fold the base portion 20 of the playpen, a user may pull the resilient strip 91 upwardly to drive the base portion 20 and the two bracket members 32 upwardly, whereby, each of the drive posts 10 is able to pivot relative the base portion 20 about the pivot axle 26 on the block member 21, each of the linking rods 31 is able to pivot relative to the bracket member 32 about the pivot axle 35 and pivot relative to the fastener member 11 about the pivot axle 17 such that the four vertical stands 93 are driven by the drive posts 10 to displace in parallel towards the base portion 20 so as to fold the playpen. FIG. 7 shows the playpen is in a folded status. Conversely, when expanding, the user just needs to push the base portion 20 downwardly to displace the four vertical stands 93 in parallel outwardly by the drive posts 10, thereby expanding the base portion of the playpen.

It should be clear to those skilled in the art that further embodiments of the present invention may be made without departing from the teachings of the present invention.

I claim:

1. A control device for folding and expanding a base portion of a playpen which comprises four vertical stands (93) respectively mounted on four corners thereof and a base portion (20) mounted on an underside thereof, four drive posts (10) each having a first end pivotally connected to a lower end of a corresponding one of said four vertical stands (93) and having a second end pivotally connected to said base portion (20), and a flexible casing (90) enclosed around a peripheral portion of said playpen and having an underside engaged with said base portion (20), said control device comprising:

four block members (21) each fixed on said base portion (20) and each pivotally engaged with the second end of a corresponding one of said four drive posts (10);

four fastener members (11) each mounted around a mediate portion of a corresponding one of said four drive posts (10); and two transmission assemblies (30) each pivotally mounted between two of said four drive posts (10) and arranged opposite to each other, each of said two transmission assemblies (30) comprising:

a bracket member (32) mounted in a mediate portion of said transmission assembly (30), said bracket member (32) including a substantially T-shaped slot (36) having an opening facing said base portion (20) forming two flange portions (360);

a pair of linking rods (31) each having a first end pivotally engaged with a corresponding one of said four fastener members (11) located on associated said drive post (10) and each having a second and pivotally engaged with said bracket member (32); and a resilient strip (91) having a mediate portion attached to said base portion (20) and having two free ends each formed into a loop (92) which is received by said two flange portions (360) of said bracket member (32).

2. The control device in accordance with claim 1, wherein each of said block members (21) defines a longitudinal recess (24) therein having an opening facing downwardly and further defines a vertical compartment (27) therethrough which communicates with said recess (24), a pair of aligned holes (25) transversely defined through said block member (21) and communicating with said vertical compartment (27), the second end of said drive post (10) being received in said longitudinal recess (24) and defining a transverse bore (101) therethrough which aligns with said pair of holes (25), a pivot axle (26) extending through said pair of holes (25) and said bore (101) such that said drive post (10) is pivotally engaged with said block member (21) at said pivot axle (26), whereby, the second end of said drive post (10) is received in said vertical compartment (27) when said drive post (10) is rotated about said pivot axle (26).

3. The control device in accordance with claim 1, wherein each of said fastener members (11) defines a recess (15) therein having an opening facing towards said base portion (20) and defines a compartment (18) therethrough which communicates with said recess (15), a pair of aligned holes (16) vertically defined through said fastener member (11) and communicating with said compartment (18), the first end of said linking rod (31) being received in said recess (15) and defining a vertical bore (311) therethrough which communicates with said pair of holes (16), a pivot axle (17) extending through said pair of holes (16) and said vertical bore (311) such that said linking rod (31) is pivotally engaged with said fastener member (11) at said pivot axle (17), whereby, the first end of said linking rod (31) is received in said compartment (18) when said linking rod (31) is rotated about said pivot axle (17).

4. The control device in accordance with claim 1, wherein each of said bracket members (32) has two distal ends and defines a substantially U-shaped recess therethrough which has an opening facing opposite said base portion (20), a pair of aligned holes (34) vertically defined through each of the distal ends of said bracket member (32), the second end of said linking rod (31) being received in said recess (33) and defining a vertical bore (312) therethrough which communicates with said pair of holes (34) in a corresponding distal end of said bracket member (32), a pair of pivot axles (35) each extending through said pair of holes (34) and said vertical bore (312) such that said linking rod (31) is pivotally engaged with said bracket member (32) at said pivot axle (35).

* * * * *